United States Patent [19]

Gross

[11] 4,293,828

[45] Oct. 6, 1981

[54] ARRANGEMENT FOR SUPPRESSING INTERFERENCE WAVES AND HARMONIC WAVES IN TRAVELING WAVE TUBES WITH A SHORT CIRCUITING SLIDE IN THE OUTPUT WAVE GUIDE

[75] Inventor: Franz Gross, Loerrach, Fed. Rep. of Germany

[73] Assignee: Siemens Aktiengesellschaft, Berlin & Munich, Fed. Rep. of Germany

[21] Appl. No.: 117,979

[22] Filed: Feb. 4, 1980

[30] Foreign Application Priority Data

Mar. 2, 1979 [DE] Fed. Rep. of Germany ..... 2908218

[51] Int. Cl.[3] ..... H01P 1/212; H01P 1/26; H01P 1/28

[52] U.S. Cl. ..... 333/27; 333/22 R; 333/81 B; 333/251; 333/253

[58] Field of Search ..... 333/202, 206–212, 333/22 R, 22 F, 27, 81 A, 81 B, 245, 248, 251, 253–254; 315/3.5, 3.6, 39.53; 333/24 R, 260

[56] References Cited

U.S. PATENT DOCUMENTS 3,353,123 11/1967 Met ..... 333/211

FOREIGN PATENT DOCUMENTS 2132092 3/1975 Fed. Rep. of Germany .
1391970 4/1975 United Kingdom .

*Primary Examiner*—Marvin L. Nussbaum
*Attorney, Agent, or Firm*—Hill, Van Santen, Steadman, Chiara & Simpson

[57] ABSTRACT

An arrangement for suppressing interference waves and harmonic waves in traveling wave tubes has a short circuit slide in an output wave guide in which the slide has a groove in the form of a λ/4 or λ/2 wave guide element in its frontal surface which is the effective short circuit plane. The groove has an attenuation element arranged therein.

10 Claims, 2 Drawing Figures

ARRANGEMENT FOR SUPPRESSING INTERFERENCE WAVES AND HARMONIC WAVES IN TRAVELING WAVE TUBES WITH A SHORT CIRCUITING SLIDE IN THE OUTPUT WAVE GUIDE

BACKGROUND OF THE INVENTION

1. Field of the Invention

The present invention relates to an arrangement for suppressing interference waves and harmonic waves in traveling wave tubes with a short circuiting slide in the output wave guide.

2. Description of the Prior Art

German Patent No. 2,132,092 discloses a high frequency line in the form of a wave guide or coaxial conductor which has at least one attenuated auxiliary line coupled thereto, the auxiliary line being tuned to the frequency of the spurious oscillations by way of a number of periodically consecutive coupling openings, as a filter for undesired spurious oscillations, particularly harmonic waves. The auxiliary line is dimensioned such that the fundamental wave which is to be transmitted through the main line lies outside of the transmission range of the auxiliary line and the spurious oscillations couple into the auxiliary line from the main line. The auxiliary line is provided with a delay structure which is housed in the wall of the main line, to which attenuation bodies are brought into close proximity so as to displace the transmission range of the auxiliary line to longer waves.

Harmonic waves and higher interfering waves cause ripple in the frequency response of the amplification curve and the group delay of traveling wave amplifiers and, thus, such waves must be reduced to a small level. This occurs by means of a harmonic wave filter in the form of an attenuated delay line which greatly reduces the harmonic waves, but which insignificantly reduces the fundamental wave.

SUMMARY OF THE INVENTION

The object of the present invention is to provide an arrangement for suppressing interference waves and harmonic waves in traveling wave tubes, with which not only the interference waves in the limited transition range of the delay line are attenuated, but rather all higher interfering modes are attenuated in a broad band.

The above object is achieved, according to the present invention and in an arrangement of the type initially mentioned, in that a short circuiting slide is provided which has a groove in its frontal surface (effective short circuit plane) in the form of $\lambda/4$ or $\lambda/2$ wave guide element in which an attenuating element is arranged.

The attenuation element is therefore arranged in a practical manner in the center of the groove and comprises a dielectric material. Preferably, the attenuation element is provided with an attenuation layer.

According to another feature of the invention, the groove is provided perpendicularly into the frontal surface of the short circuit slide and extends at a right angle beneath the frontal surface such that the groove is designed approximately with a L-shape. The groove is thereby preferably filled with a dielectric material as an attenuation element.

According to the present invention, in a practical manner, the fundamental mode is almost completely reflected at the groove on the short circuit slide, whereas only the interfering mode penetrates and is substantially damped. The arrangement according to the present invention has the further advantage that it is simple in structure and inexpensive to manufacture. It has the further advantage that not only the interfering waves in the limited transmission range of the delay line are attenuated, but rather all higher interfering modes are attenuated in a broad band.

BRIEF DESCRIPTION OF THE DRAWING

Other objects, features and advantages of the invention, its organization, construction and mode of operation will be understood from the following description, taken in conjunction with the accompanying drawing, on which.

DESCRIPTION OF THE PREFERRED EMBODIMENTS

Figure 1:
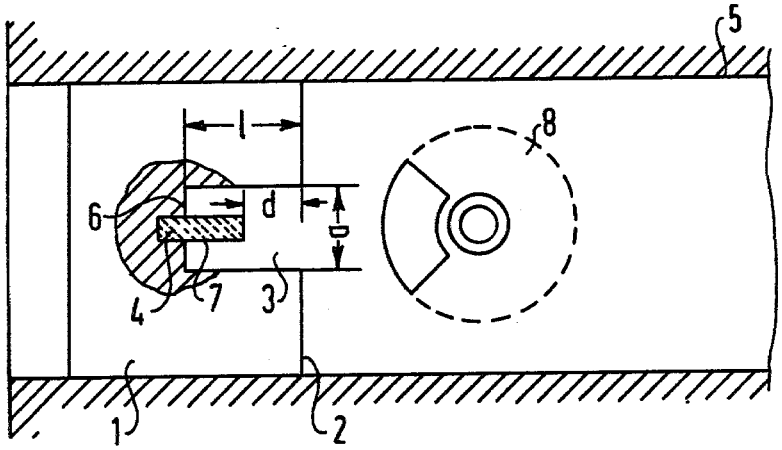
FIG. 1 is a schematic view, shown in section, of an arrangement constructed in accordance with the present invention.

Referring to the arrangement illustrated in FIG. 1, a short circuit slide 1 has a groove 3 therein which has a length l and a width a in an output wave guide 5 of a traveling wave 2, the groove 3 being provided in the frontal surface 2 which is the effective short circuit plane. The width a is dimensioned such that the threshold frequency of the wave guide element which is formed by the groove 3 is approximately 10% lower than the frequency of the first interfering mode. An attenuation element 4 is arranged in the floor 6 of the groove 3 and extends to a point which is spaced an amount d from the frontal surface 2. The attenuation element 4, which consists of ceramic for example, is preferably coated with an attenuation layer 7, for example, a graphite layer. The dimension d is determined such that the fundamental mode at the spacing d from the frontal surface 2 of the short circuit slide 1 is already so strongly attenuated (reflection attenuation) that no significant portion of its energy reaches this plane. The attenuation element 4, which is arranged in the floor 6 of the groove 3, is not reached by the fundamental mode, but is reached by all interfering modes, and attenuates such interfering modes in a wide band. All interfering waves which enter from a delay line 8 into the output wave guide 5 are therefore effectively attenuated, whereas the fundamental mode does not reach the attenuation element 4, since it is reflected without loss at the frontal surface 2 of the short circuit slide.

If the available radial space for the short circuit slide 1 is small and, therefore, the distance from the delay line 8 to the end of the short circuit slide 1 is also small, within which distance the sealing soldering must be provided, then the groove 3 in the short circuit slide 1 can be ground into the frontal surface 2 of the short circuit slide 1 as a prismatic recess. Instead of hollowed, tapered ceramic elements as an attenuation element 4, also magnetically attenuating elements or coatings can be provided in the segment l-*d* of the groove 3 for the broad band attenuation of the interfering waves.

Figure 2:
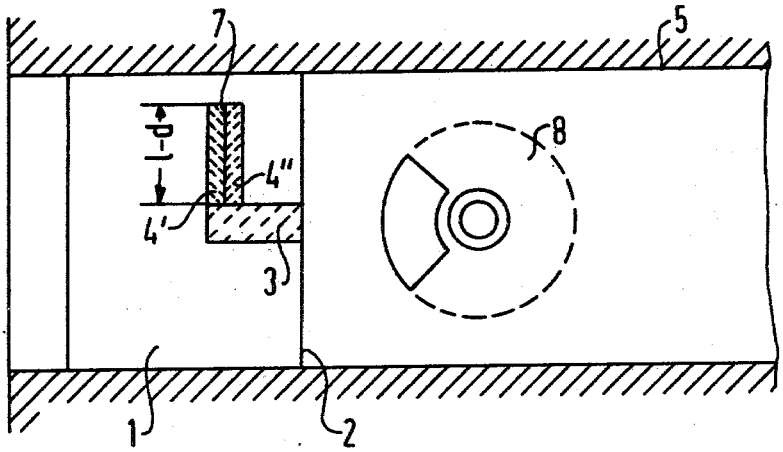
FIG. 2 is a schematic view, in section, of another embodiment of the invention.

In the case of the embodiment illustrated in FIG. 2, the groove 3 is installed vertically into the frontal surface 2 and extends at a right angle under the frontal surface 2 such that the groove 3 has an approximate L-shape. The groove 3 is filled with a dielectric material as an attenuating element 4 for a decreasing of the width a. In this exemplary embodiment, the abutting surfaces of the attenuation elements 4', 4'' are attenuated only on the distance l-*d*, so that only the interfering waves and not the fundamental mode are attenuated. For decreasing the width a of the groove 3, also a ridge wave guide is possible.

Although I have described my invention by reference to particular illustrative embodiments thereof, many changes and modifications of the invention may become apparent without departing from the spirit and scope of the invention. I therefore intend to include within the patent warranted hereon all such changes and modifications as may reasonably and properly be included within the scope of my contribution to the art.

I claim:

1. An arrangement for suppressing interfering waves and harmonic waves in a traveling wave tube, comprising:

an output wave guide coupled to the traveling wave tube;

said output wave guide including a member therein comprising a frontal surface which is an effective short circuit plane which reflects the fundamental mode;

a groove in said frontal surface as a $\lambda/4$ wave guide element; and attenuation means mounted in said wave guide element.

2. The arrangement of claim 1, wherein said attenuation means is mounted centrally in said $\lambda/4$ wave guide element and comprises a dielectric material.

3. The arrangement of claim 1, wherein said attenuation means comprises an attenuating layer.

4. The arrangement of claim 1, wherein said groove is L-shaped and includes a first portion extending perpendicular to said frontal surface and a second portion extending parallel to and beneath said frontal surface.

5. The arrangement of claim 4, wherein said attenuation means comprises a dielectric material filling said groove.

6. An arrangement for suppressing interfering waves and harmonic waves in a traveling wave tube, comprising:

an output wave guide coupled to the traveling wave tube;

said output wave guide including a member therein comprising a frontal surface which is an effective short circuit plane which reflects the fundamental mode;

a groove in said frontal surface as a $\lambda/2$ wave guide element; and attenuation means mounted in said wave guide element.

7. The arrangement of claim 6, wherein said attenuation means is mounted centrally in said $\lambda/2$ wave guide element and comprises a dielectric material

8. The arrangement of claim 6, wherein said attenuation means comprises an attenuating layer.

9. The arrangement of claim 6, wherein said groove is L-shaped and includes a first portion extending prependicular to said frontal surface and a second portion extending parallel to and beneath said frontal surface.

10. The arrangement of claim 9, wherein said attenuation means comprises a dielectric material filling said groove.

* * * * *